United States Patent [19]

Bird

[11] 4,132,055

[45] Jan. 2, 1979

[54] EQUESTRIAN HARNESS AND SADDLERY EQUIPMENT

[76] Inventor: Elizabeth A. Bird, Mill House, Mill Lane, Wychbold, Droitwich, West Midlands, England

[21] Appl. No.: 722,597

[22] Filed: Sep. 13, 1976

[30] Foreign Application Priority Data

Sep. 12, 1975 [GB] United Kingdom ..... 37531/75

[51] Int. Cl.[2] ..... B68C 1/00; B68C 1/14

[52] U.S. Cl. ..... 54/23; 2/316; 54/58

[58] Field of Search ..... 54/23, 79, 65, 66, 58; 2/311, 316, 317; 128/133

[56] References Cited

U.S. PATENT DOCUMENTS

| | | | |
|---|---|---|---|
| 160,560 | 3/1875 | Witter | 54/23 |
| 174,478 | 3/1876 | Chase | 54/23 |
| 199,318 | 1/1878 | Sanford | 54/23 |
| 1,678,514 | 7/1928 | Hulbert | 54/23 |
| 2,130,214 | 9/1938 | Wright | 54/23 |
| 3,466,852 | 9/1969 | Stoner | 54/79 |
| 3,530,031 | 9/1970 | Loew | 2/311 |
| 3,805,491 | 4/1974 | Deal | 54/23 |
| 3,807,135 | 4/1974 | Leiderman | 54/23 |
| 3,807,136 | 4/1974 | Deal | 54/79 |
| 3,828,521 | 8/1974 | Dulaney | 54/23 |

*Primary Examiner*—Clyde I. Coughenour
*Attorney, Agent, or Firm*—Neil F. Markva

[57] ABSTRACT

A body strap component of equestrian harness or saddlery equipment, such as a girth, surcingle or roller, is disclosed which comprises an elongate tubular webbing sheath formed of woven yarn composed of staple fibers of a polyester synthetic polymer material. The webbing sheath is filled by an insert filling composed of a strip of porous foam expanded plastics material. The ends of the sheath are sealed and are provided with relatively short end straps carrying buckle fastening fittings. Adjacent the end straps, a longitudinally-extending reinforcing band is secured to the sheath and has an elasticity less than the elasticity of the sheath material.

9 Claims, 4 Drawing Figures

EQUESTRIAN HARNESS AND SADDLERY EQUIPMENT

BACKGROUND OF THE INVENTION

The present invention relates to equestrian harness or saddlery equipment and particularly concerns body strap components thereof such as girths, surcingles and rollers.

Traditionally, the bulk of such equipment, including the body strap components specified, have been made of leather. Although leather can generally be excellently suited for this purpose, it is a relatively costly material. It must be carefully selected and prepared to provide the requisite quality and needs careful and proper maintenance in use. Consequently, there has been some interest in the use of alternative substitute materials as a replacement for the traditional leather. However with at least some items of equipment, such as the aforementioned body strap components, there are various practical problems which have generally given certain disadvantages in performance when adopting alternative substitute materials.

For example, various types of girths which have been produced include cotton or wool webbing girths, all elastic girths composed of elastomeric material, lampwick girths and girths composed of nylon cords. Each of these different types, however, have usually been found to have some practical characteristics which make them less satisfactory than is to be desired, arising from one or more of the following reasons:

(a) a tendency to rot giving a limited life;

(b) a tendency for an excessive sweat absorption and insufficient "breathing" of the material leading possibly to hardening or other deterioration in physical characteristics of the material;

(c) a low resistance to washing which has a deleterious effect on the article or material thereof;

(d) insufficient or excessive resilience or elasticity;

(e) a tendency to chafe or to exert excessive pressure unevenly, in undesirable localized areas, against the body of the horse.

For these and other various reasons, there is scope for providing improved forms of such body strap components of saddlery equipment composed, at least principally, of a material other than leather.

SUMMARY OF THE INVENTION

From one aspect, the present invention provides a body strap component of equestrian harness or saddlery equipment, such as a girth, surcingle or roller, comprising an elongate tubular webbing sheath, an insert filling and an end strap assembly. The sheath is formed by woven yarn composed of staple fibers of synthetic polymer material. The insert filling is composed of at least one strip of foam expanded plastics material extending between closed ends of said sheath and filling the interior thereof. The end strap assembly includes relatively short end straps secured to the end portions of the sheath. The end straps carry strap fastening fittings such as buckles.

The invention also includes the method of making body strap components of equestrian harness or saddlery equipment of the kind defined above, and equestrian harness or saddlery equipment incorporating such body strap components.

Preferably, the staple fibers making up the yarn from which the sheath is woven are composed of chopped filaments of a polyester synthetic polymer material, for example, a polyester of terephthalic acid and a glycol such as the material sold under the name 'Terylene', and the foam expanded plastics material may be a foam expanded polyethylene.

Also, in preferred embodiments, the end straps carrying the fastening fittings are composed of woven plastics filamentary material such as nylon braid or webbing, and are machine stitched to the ends of the sheath including the filling therein.

BRIEF DESCRIPTION OF DRAWINGS

By way of example, one construction of body strap component in the form of a girth made in accordance with the invention is illustrated in the accompanying drawing.

In said drawing.

DESCRIPTION OF SPECIFIC EMBODIMENTS

Figure 1:
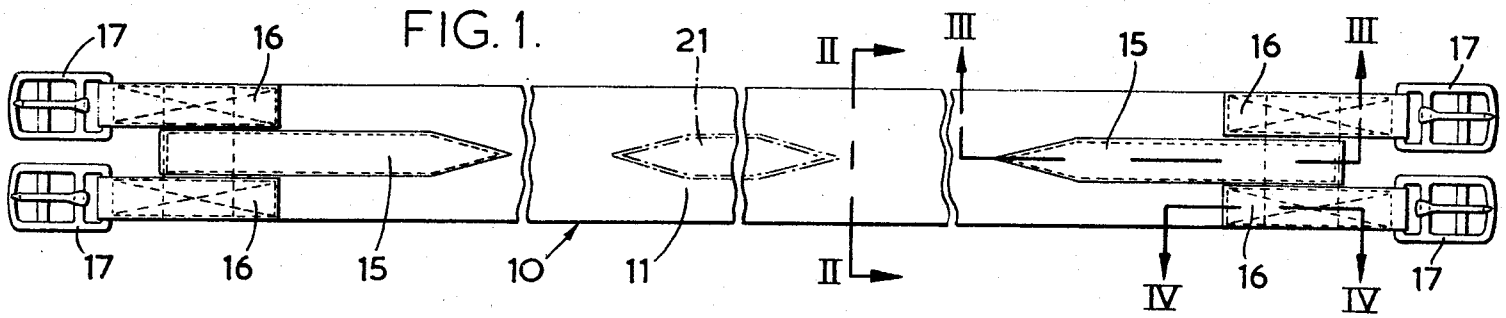
FIG. 1 is an elevational view.
Figure 3:
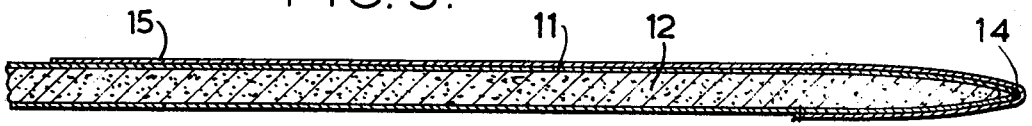
FIG. 3 is a fragmentary sectional view on line III—III of FIG. 1.
Figure 4:
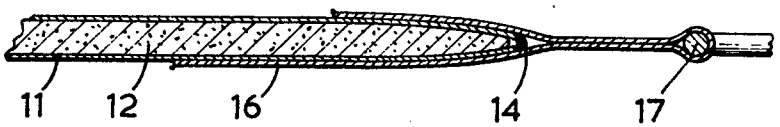
FIG. 4 is a fragmentary sectional view on line IV—IV of FIG. 1.
Figure 2:
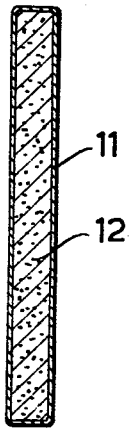
FIG. 2 is a cross-sectional view on line II—II of FIG. 1.

The girth illustrated in the drawing has a main strap portion 10 which comprises an elongate tubular webbing sheath 11 of substantially rectangular cross-section containing an insert filling 12. As shown, sheath 11 has an endless cross-section and is closed at opposite ends thereof.

The sheath 11 in this embodiment is formed of woven yarn composed of staple polyester fiber, such as a 'Terylene' fiber, a very suitable material being that marketed under a reference number WR1219T by the firm of W. Ribbons Limited which has a texture and appearance very similar to woven cotton fabric.

The insert filling 12 consists of a single continuous strip which has a substantially rectangular cross-section commensurate with the interior cross section of the sheath. Filling strip 12 extends from end to end of the sheath and is composed of foam cross-linked expanded polyethylene such as the material marketed by Rubber & Plastic Industries Limited of Birmingham under the trade name EVAZOTE or PLASTAZOTE. This is a compressible sponge-like resilient material which gives shape and substance to the girth.

In making up the girth, the insert filling 12 may conveniently be introduced into the sheath 11 from one end using a removable tool or implement in the form of a trough shaped carrier which is withdrawn after the insert filling is in position in fairly close fitting relationship within the sheath. The open ends of the sheath may then conveniently be heat-sealed, as indicated at 14. The girth is completed by securing to each end portion of the sheath a central reinforcing band or strip 15 and a pair of short end straps 16 carrying attachment fittings in the form of high quality rustless buckles 17.

The reinforcing band or strip 15 and the end straps 16 are advantageously made of nylon braid or webbinb having an elasticity or resilient stretch less than that of the sheath material. Band 15 and straps 16 are secured, so as to cover the ends of the sheath as shown, by machine stitching with nylon thread to the end portions of the sheath 11 with the stitches passing through the insert filling 12 which is locally compressed. It will be noted that the reinforcing band or strip 15, which lies between the two end straps 16 at each end, extends inwards along the length of the sheath for a considerable distance beyond the end straps thereby distributing stress loading upon the sheath in this region when in use. That is, as shown, straps 16 extend a first limited distance along the length of sheath 11 and bands 15 extend a second limited distance of sheath 11 beyond straps 16 to reduce the overall elasticity of the body strap component.

The construction of the girth described above is found to be extremely well-suited to its purpose. It is fully rot-proof with the materials employed and repeated washings which will not cause any deterioration. Moreover, it provides freedom from any tendency to chafe the horse due to the tubular webbing sheath having a soft cotton-like texture and being free of sharp or hard edges. It is not adversely affected in use by sweat or moisture absorption. It has sufficient but not excessive resilient stretch and surface characteristics as to give adequate friction grip qualities without unduly constraining the horse. Although it is soft and flexible, the girth has very high strength and hard wearing long-life characteristics.

It may be desired to control the elasticity or resilient stretch of the girth during its manufacture because, for example, the webbing sheath used is such that it gives an elasticity greater than is required. Such control may be effected by adjusting the length which overlaps the sheath of the end straps 16 or of the reinforcing bands 15. Control may also be effected by securing, such as by stitching, one or more additional webbing bands or strips of woven nylon or like material to the sheath in the middle portion of its length. Such additional webbing band or strip will have an elasticity less than that of the sheath material and will be of a length appropriate to give the reduction desired in overall elasticity.

By way of example, one such additional band or strip 21 may for instance have a length equal to about a quarter of the overall length of the sheath 11 as indicated in broken lines in FIG. 1. Such additional band or strip may also be distinctively colored to provide an attractive or symbolic visual effect.

It will be appreciated that the same form of construction may also be applied to, and is appropriate for, surcingles and rollers which are subject to similar design requirements and problems.

I claim:

1. A body strap component of equestrian harness equipment comprising:

(a) an elongate tubular webbing sheath having a woven endless cross-section and being closed at opposite ends thereof, (b) said sheath being woven from yarn composed of staple fibers of synthetic polymer material, (c) an insert filling composed of at least one strip of foam expanded plastics material extending between said closed ends of said sheath and filling the interior thereof, (d) two end straps secured to each end and along each edge of the sheath and a central longitudinally extending reinforcing band being disposed between each pair of end straps, (e) said end straps and bands being composed of a material having an elasticity less than the elasticity of the sheath, (f) said end strps extending a first limited distance along the length of the sheath and said bands extending a second limited distance along the sheath beyond the end straps to reduce the overall elasticity of the body strap component, and (g) strap fastening fittings such as buckles carried by said end straps.

2. A body strap component according to claim 1, wherein the staple fibers making up the yarn from which the sheath is woven are chopped filaments of a polyester synthetic polymer material.

3. A body strap component according to claim 2, wherein the polyester synthetic polymer material is a polyester of terephthalic acid and a glycol.

4. A body strap component according to claim 1, wherein the foam expanded plastics material of the insert filling is a resiliently compressible foam cross-linked expanded polyethylene.

5. A body strap component according to claim 1, wherein the insert filling consists of a single strip of the foam expanded plastics material having a substantially rectangular cross-section commensurate with the interior cross-section of the sheath.

6. A body strap component according to claim 1, wherein the sheath has secured thereto, intermediate its ends, at least one additional webbing band composed of a material having an elasticity less than that of the sheath material to further control the overall elasticity of the body strap component.

7. A body strap component according to claim 1, wherein said strips and band at each end of the sheath having a width effective to substantially cover said closed ends.

8. An equestrian harness including a body strap component, said body strap component comprising:

(a) an elongate tubular webbing sheath formed of woven yarn composed of chopped filaments of polyester synthetic polymer material and heat sealed at its ends, (b) an insert filling consisting of a strip of foam expanded plastics material extending between the closed ends of said sheath and filling the interior thereof, (c) a spaced pair of end straps secured to end portions of the sheath adjacent each of the closed ends thereof, (d) strap fastening fittings carried by said end straps, (e) a central longitudinally-extending reinforcing band disposed between each pair of end straps and secured to the respective end portions of the sheath, (f) said reinforcing band having an elasticity less than the elasticity of the sheath material, and (g) plastics filament thread stitching passing through the end portions of the sheath and through the insert filling securing the end straps and each reinforcing band to the sheath and locally compressing the insert filling.

9. A body strap component of equestrian harness equipment comprising:

(a) an elongate tubular webbing sheath having a woven endless cross-section and being closed at opposite ends thereof, (b) said sheath being woven from yarn composed of staple fibers of synthetic polymer material, (c) an insert filling composed of at least one strip of foam expanded plastics material extending between said closed ends of said sheath and filling the interior thereof, (d) a pair of end straps and a reinforcing band being secured to each end portion of the sheath adjacent said closed ends and extending a limited distance along the length of the sheath to reduce the overall elasticity of the body strap component, (e) said end straps and reinforcing bands each being composed of nylon webbing having an elasticity less than the elasticity of the sheath, (f) each said reinforcing band being disposed between each pair of said end straps, and (g) strap fastening fittings such as buckles carried by said end straps, (h) said straps and bands having a width effective to cover the ends of the sheath and being secured by maching stitching with plastics filament thread passed through the end portions of the sheath and through the insert filling which is locally compressed.

* * * * *